US007265717B2

(12) United States Patent
Saitou et al.

(10) Patent No.: US 7,265,717 B2
(45) Date of Patent: Sep. 4, 2007

(54) ULTRA-WIDEBAND ANTENNA AND ULTRAHIGH FREQUENCY CIRCUIT MODULE

(75) Inventors: Akira Saitou, Machida (JP); Kazuhiko Honjo, Chofu (JP)

(73) Assignee: YKC Corporation, Tokyo (JP)

( * ) Notice: Subject to any disclaimer, the term of this patent is extended or adjusted under 35 U.S.C. 154(b) by 362 days.

(21) Appl. No.: 10/971,490

(22) Filed: Oct. 22, 2004

(65) Prior Publication Data

US 2005/0088344 A1 Apr. 28, 2005

(30) Foreign Application Priority Data

Oct. 24, 2003 (JP) ..... 2003-365149

(51) Int. Cl.
*H01Q 1/38* (2006.01)
*H01Q 9/28* (2006.01)

(52) U.S. Cl. ..... 343/700 MS; 343/795

(58) Field of Classification Search ..... 343/700 MS, 343/795, 793, 821, 822
See application file for complete search history.

(56) References Cited

U.S. PATENT DOCUMENTS

| | | | | |
|---|---|---|---|---|
| 3,747,114 | A * | 7/1973 | Shyhalla | 343/795 |
| 6,177,909 | B1 | 1/2001 | Reid et al. | |
| 7,098,863 | B2 * | 8/2006 | Bancroft | 343/859 |
| 7,138,954 | B2 * | 11/2006 | Schillmeier et al. | 343/795 |
| 2003/0043084 | A1 | 3/2003 | Egashira | |
| 2004/0012529 | A1 | 1/2004 | Teshirogi et al. | |
| 2004/0164903 | A1 * | 8/2004 | Tran | 343/700 MS |
| 2005/0035919 | A1 * | 2/2005 | Yang et al. | 343/795 |
| 2005/0146480 | A1 * | 7/2005 | Yazdandoost et al. | 343/795 |

FOREIGN PATENT DOCUMENTS

WO WO 01/61784 A1 8/2001

OTHER PUBLICATIONS

DuHamel, R.H. and D.E. Isbell, "Broadband Logarithmically Periodic Antenna Structures," IRE National Convention Record:119-128, 1957.

Puente-Baliarda, Carles, et al., "On the Behavior of the Sierpinkski Multiband Fractal Antenna," *IEEE Transactions on Antennas and Propagation 46*(4):517-524, 1998.

Pues, H.F. and A.R. Van de Capelle, "An Impedance-Matching Technique for Increasing the Bandwidth of Microstrip Antennas," *IEEE Transactions on Antennas and Propagation AP37*(11):1345-1354, 1989.

Rumsey, V.H., "Frequency Independent Antennas," Paper #339, National IRE Meeting, New York, p. 114-118, 1957.

* cited by examiner

*Primary Examiner*—Hoanganh Le
(74) *Attorney, Agent, or Firm*—Christensen O'Connor Johnson Kindness PLLC

(57) ABSTRACT

One of the objects of this invention is to realize an antenna having low reflection loss over an extremely wideband. The antenna of the present invention is provided with a dielectric substrate, a plurality of antenna conductors formed on one surface of the dielectric substrate that are pseudo self-complementary on the surface, and a plurality of feed conductors symmetrical with respect to symmetrical surfaces of the antenna conductors, wherein a gap for a wavelength of 1/10 or less that of the wavelength of a usage frequency in a vacuum is provided at a center of rotational symmetry between the plurality of antenna conductors.

7 Claims, 17 Drawing Sheets

(a)

(b)

ULTRA-WIDEBAND ANTENNA AND ULTRAHIGH FREQUENCY CIRCUIT MODULE

BACKGROUND OF THE INVENTION

1. Field of the Invention

This invention relates to an ultra wideband antenna and an ultrahigh frequency circuit module that can be applied to an ultra-wideband wireless system or the like to enable high speed transmission.

2. Description of the Related Art

In recent years, close range wireless interfaces such as wireless LANs and Bluetooth (trademark) have become widely used, but ultra-wideband wireless systems (UWB) have been receiving attention as the next generation of systems to enable even higher speed transmission. Specification investigations are currently progressing in various countries, but it is recognized that the usage frequency for these UWB systems in the US is 3.1-10.6 GHz with a comparatively large output. This UWB system is capable of high speed wireless transmission at 100 Mbps or above due to use of high frequencies in an extremely wide band, but it is not easy to implement an antenna for transmission of this type of wideband signal.

SUMMARY OF THE INVENTION

The major factor hampering wideband characteristics is widely known to be that input impedance matching of the antenna cannot be achieved. There are two causes for this, the first that there is large variation in antenna input impedance due to frequency, and the second is that the antenna input impedance and the external impedance are different.

The present invention solves the above described problems, and provides an ultra-wideband antenna and an ultrahigh frequency circuit module to achieve an extremely wide band.

An ultra-wideband antenna of the present invention is provided with a dielectric substrate, a plurality of antenna conductors formed on one surface of the dielectric substrate that are pseudo self complementary on the surface, and a plurality of feed conductors symmetrical with respect to a symmetrical surface of the antenna conductors, wherein a gap for a wavelength of 1/10 or less that of the wavelength of a usage frequency in a vacuum is provided at a center of rotational symmetry between the plurality of antenna conductors.

It is possible for the plurality of feed conductors to be provided on a surface opposite to the surface provided with the plurality of antenna conductors, and to provide a plurality of via holes passing through the dielectric substrate symmetrically with respect to a symmetrical surface of the plurality of antenna conductors to connect the plurality of feed conductors to the plurality of antenna conductors.

It is also possible to further provide a second dielectric substrate on the antenna conductors, arranged so that the antenna conductors are sandwiched by a plurality of dielectric substrates.

It is also possible to have a structure where widths of the feed conductors are different at a conductor body side and at an opposite end, and width of the feed conductors changes monotonically between the two ends.

In the event that the output impedance of an electronic circuit connected to the feed conductors is lower than the input impedance of the antenna, it is preferable for the width of the feed conductors to be narrow at a side connecting to the antenna conductors and wide at a side connecting to the electronic circuit.

In the event that the output impedance of an electronic circuit connected to the feed conductors is higher than the input impedance of the antenna, it is preferable for the width of the feed conductors to be wide at a side connecting to the antenna conductors and narrow at a side connecting to the electronic circuit.

In order to obtain impedance matching, it is necessary for a median between the impedance of an electronic circuit connected to the feed conductors and the impedance of the antenna to be realized at a midpoint of the feed conductors.

It is also possible for the plurality of feed conductors to include first sections provided on the same surface as other feed conductors, and second sections provided on surfaces opposite to the first sections, and via holes to be provided passing through the dielectric substrate to connect the first sections to the second sections, wherein the second sections and the other feed conductors constitute lecher wires sandwiching the dielectric substrate.

It is also possible to provide a microstrip connection line including ground conductor provided on a surface opposite to the surface provided on the feed conductors, and for the feed conductors to be connected to the microstrip connection line.

The widths of lecher wires and microstrip connection lines are selected so that an impedance R1 of lecher wires constituted by the feed conductors matches with an impedance R2 of the microstrip connection lines in odd mode at a desired value or less where they connect.

More specifically, line widths are selected so that at sections where lecher wires and microstrip connection lines connect, the lecher wire impedance and the odd mode impedance cause reflection to be as small as possible at a desired bandwidth. As an example of this method, there is matching design theory using a lambda/4 transformer. If this is done, at joints of the lines, it is possible to connect with no almost no reflection loss in the desired band.

A wideband high frequency circuit module of the present invention is made up of only balanced circuits, and is provided with a ultra-wideband antenna, a semiconductor integrated circuit and a connection line. The antenna is provided with a dielectric substrate, a plurality of antenna conductors formed on one surface of the dielectric substrate that are pseudo self complementary on the surface, and a plurality of feed conductors symmetrical with respect to symmetrical surfaces of the antenna conductors, wherein a gap for a wavelength of 1/10 or less that of the wavelength of a usage frequency in a vacuum is provided at a center of rotational symmetry between the plurality of antenna conductors. The semiconductor integrated circuit, has an output impedance of greater than or equal to 80 ohms and less than or equal to 300 ohms, for outputting a differential signal. The connection line connects the antenna and the semiconductor integrated circuit.

The present invention provides a method for implementing an extremely wideband antenna. In order to achieve antenna input impedance matching over a wide band, with the present invention set impedance characteristics that are not dependent on frequency are implemented with a pseudo self complementary antenna structure.

That constant impedance is normally about 200 ohms, and this is away from the vicinity of 50 ohms, which is a normal value for external impedance. The present invention provides a pattern for matching such significantly different impedances. This way of achieving impedance matching is being widely researched with unbalanced circuits, but in the antenna structure of the present invention, electrical supply lines are a necessity for balanced circuits, and there is a need for an appropriate matching method.

With respect to excitation of an antenna of the present invention, when forming a wireless module because it is necessary to perform excitation using a balanced signal it is necessary to supply balanced signals from outside. It is possible to convert between balanced signals and unbalanced signals using a balun (balanced to unbalanced converter), but in the case of handling signals of a wide band such as UWB, for example, the band of 3.1-10.6 GHz that is permitted u the US, it is necessary to make a balun that covers the wide band, which means that manufacture is extremely difficult, and cost is extremely high. With the present invention, there is also provided a structure for an ultra-wideband wireless module formed completely of balanced circuits, without the need for such a high cost balun.

According to the present invention, it is possible to realize an antenna with little reflection loss over an extremely wideband range, and a high frequency circuit (module) including the antenna.

BRIEF DESCRIPTION OF THE DRAWINGS

FIG. 1(*b*) is an enlarged view of a central part of an antenna.

FIG. 1(*c*) is another enlarged view of central part of the antenna.

FIG. 6(*a*) shows the case where the distance is narrow (distance L is small), while FIG. 6(*b*) shows the case where the distance is wide (distance L is large).

FIG. 11(*a*) shows the real component of input impedance, while FIG. 11(*b*) shows the imaginary component of input impedance.

FIG. 15(*a*) shows a surface where the antenna and a feed line are connected, and FIG. 15(*b*) shows an opposite surface.

DESCRIPTION OF THE PREFERRED EMBODIMENTS

Embodiment 1

Figure 1:
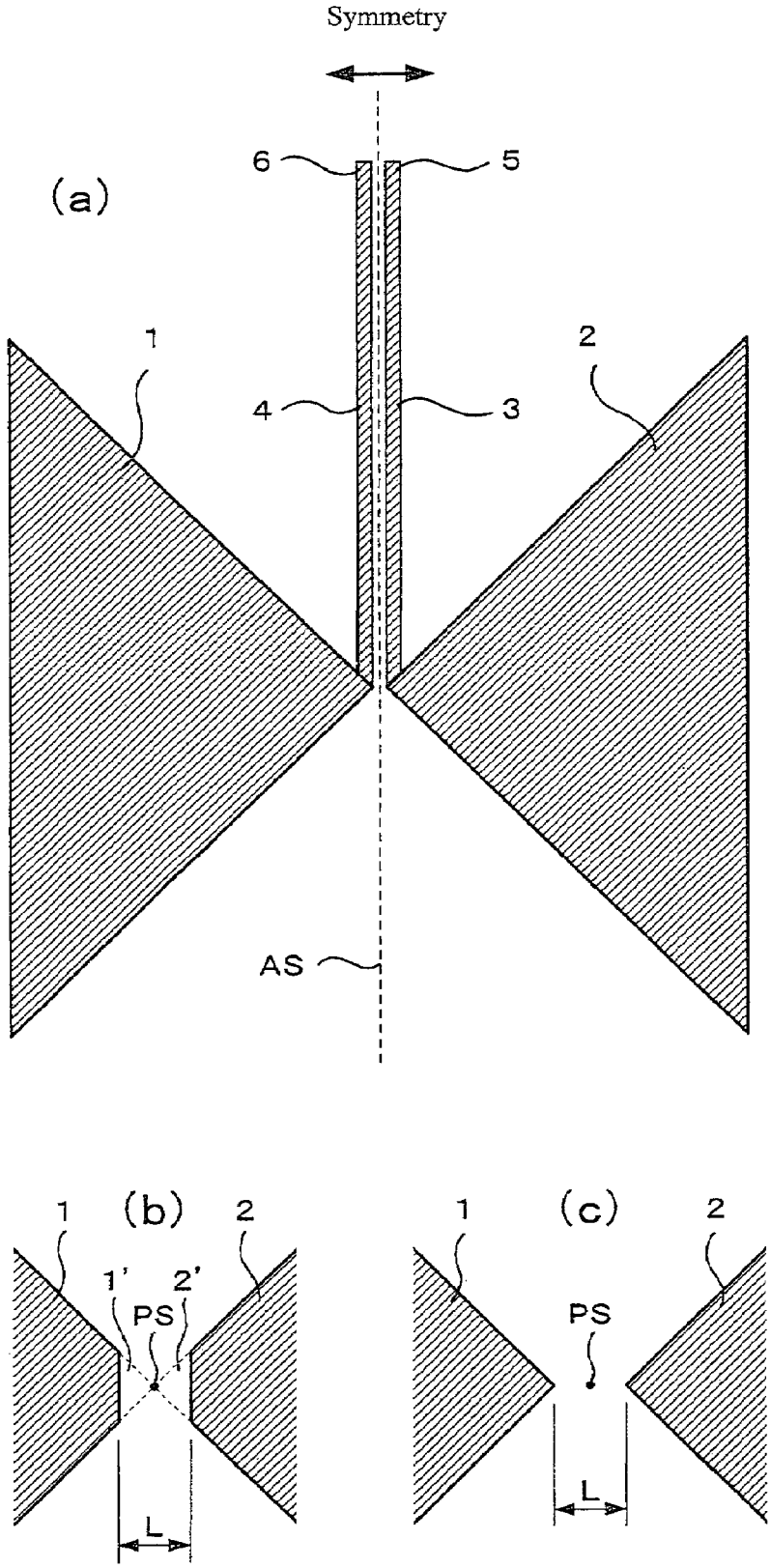
FIG. 1(*a*) is a plan view of an antenna module relating to embodiment 1 of the invention.

An antenna relating to embodiment 1 of the invention will now be described with reference to the drawings. FIG. 1(*a*) is a plan view of an antenna module relating to embodiment 1 of the invention. Reference numerals 1, 2 are antenna conductors constituting the antenna, and 3, 4 are feed conductors connected to respective one ends of the antenna conductors 1, 2. 5, 6 are ends of the feed conductors 3, 4 at an opposite side to the antenna conductors 1, 2. Signals that are 180 degrees out of phase with each other are fed from these sections 5, 6. The antenna conductors 1, 2 and the feed conductors 3, 4 are line symmetrical about an axis of symmetry AS.

FIG. 1(*b*) is an expanded drawing of a central part of the antenna. FIG. 1(*c*) shows another variation of the central part of the antenna. In FIG. 1(*b*) and FIG. 1(*c*), the feed conductors 3, 4 are omitted. A point of symmetry PS exists between the antenna conductors 1 and 2, with the antenna conductors 1 being 2 rotationally symmetrical about this point of symmetry PS, and when the antenna conductors 1, 2 are rotated 90 degrees to the left or right with this point of symmetry PS as a center, the antenna conductors 1, 2 become perfectly overlapped on sections where the conductors are not provided. A distance L is provided between the antenna conductors 1 and 2. This distance L is 1/10th or less (preferably 1/30th or less) the wavelength of a usage frequency in a vacuum. In order to prepare this distance L, as shown in FIG. 1(*b*), for example, parts of the conductors are removed at apexes (sections shown by the dotted lines of reference numeral 1' and reference numeral 2' in FIG. 1(*b*)) of right-angles of right-angled isosceles triangle shaped antenna conductors 1, 2, and as shown in FIG. 1(*c*) the antenna conductors 1, 2 are formed apart.

Figure 2:
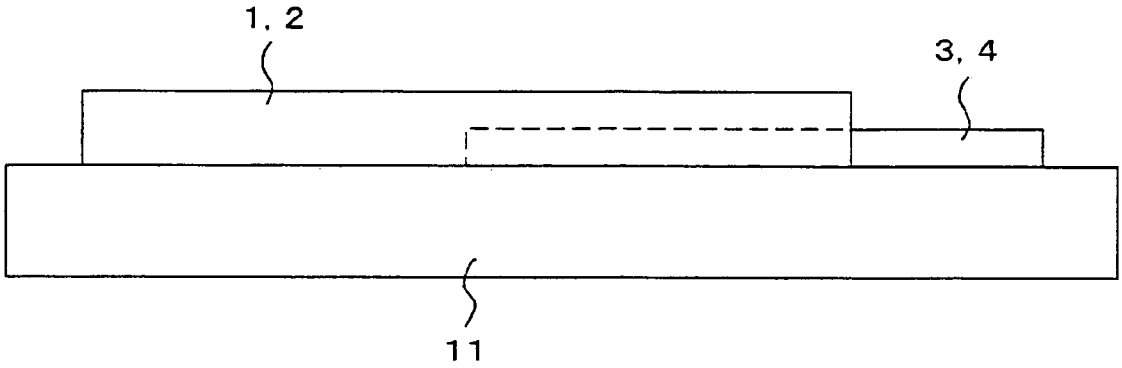
FIG. 2 is a right side view of the antenna module relating to embodiment 1 of the invention.

FIG. 2 is a right side view of an antenna module relating to embodiment 1 of the invention. Reference numeral 11 is a dielectric substrate. The antenna conductors 1, 2 and the feed conductors 3, 4 are formed on the same surface of the dielectric substrate 11.

Figure 3:
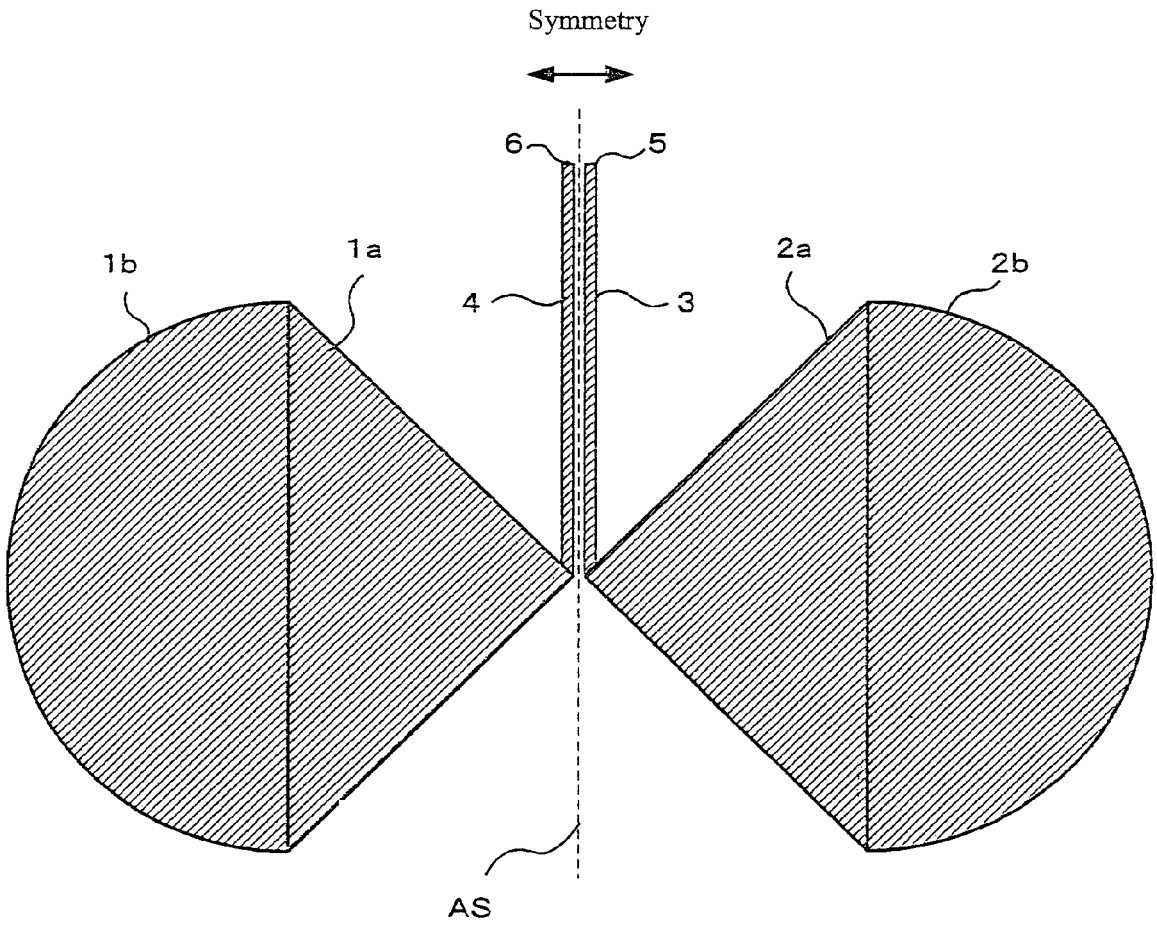
FIG. 3 is a plan view of another variation of the antenna module relating to embodiment 1 of the invention.
Figure 4:
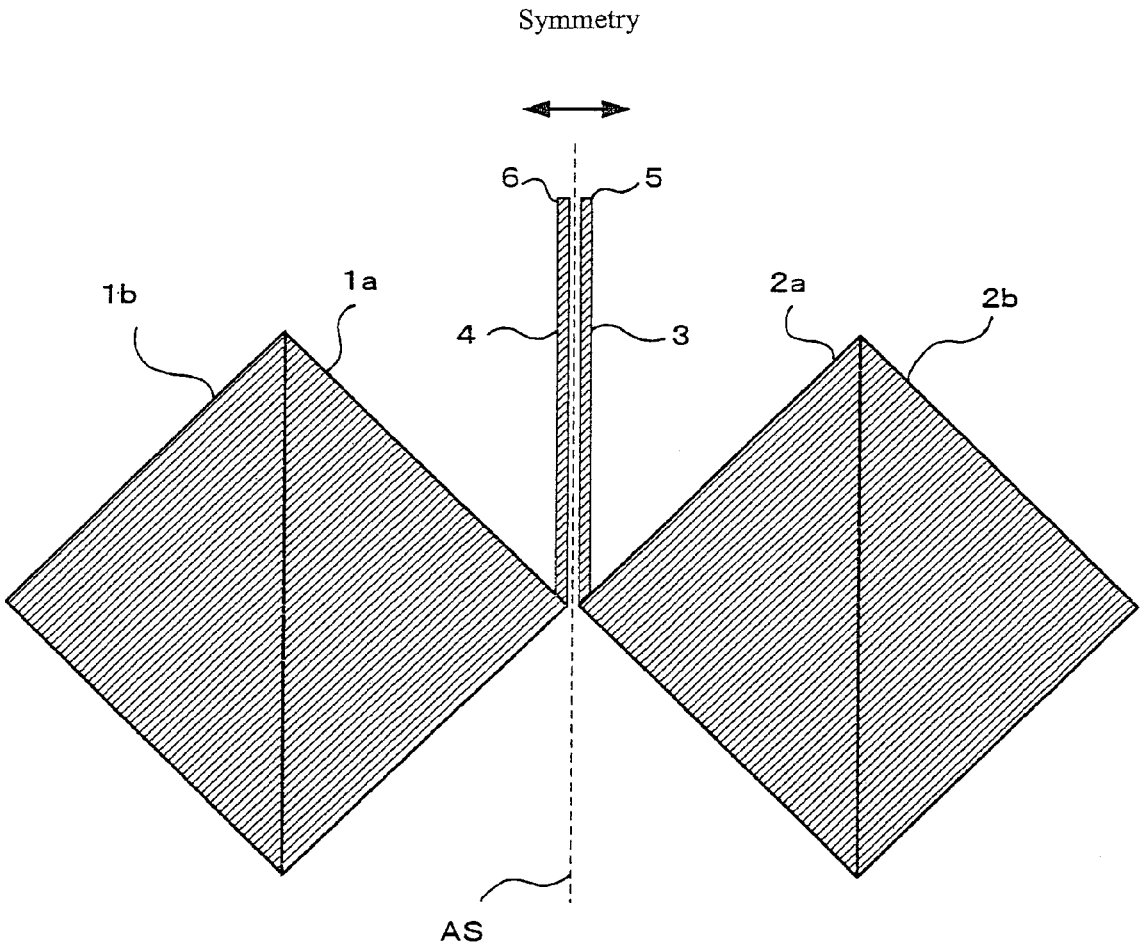
FIG. 4 is a plan view of another variation of the antenna module relating to embodiment 1 of the invention.

FIG. 3 and FIG. 4 are plan views of antenna modules relating to embodiment 1 of the invention having a different shape. With the shape of FIG. 3, the antenna conductors 1 and 2 are made up of right-angled isosceles triangle shaped sections 1*a*, 2*a*, the same as in FIG. 1(*a*), and semi-circular sections 1*b*, 2*b* connected to these sections. With the shape of FIG. 4, the antenna conductors 1 and 2 are made up of two right-angled isosceles triangle shaped sections 1*a*, 1*b* (that are the same as in FIG. 1(*a*)) and 2*a*, 2*b* (that are the same as in FIG. 1(*a*) but oriented in opposite directions) The antenna conductors 1, 2 of FIG. 4 are formed substantially square. The antenna conductors of FIG. 3 and FIG. 4 can also be realized by attaching conductors 1*b*, 2*b* to the right-angled isosceles triangle-shaped antenna conductors of FIG. 1.

Figure 5:
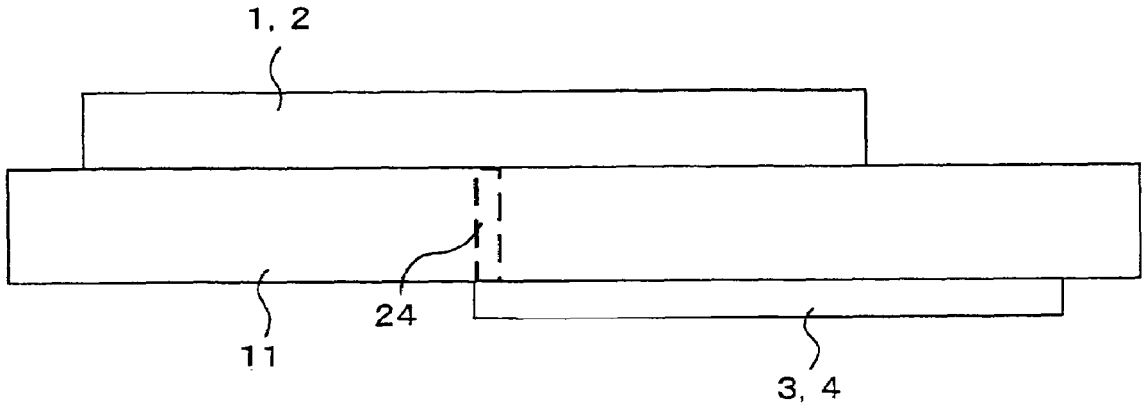
FIG. 5 is a right side view of another variation of the antenna module relating to embodiment 1 of the invention.

FIG. 5 is a right side view of an antenna module relating to embodiment 1 of the invention. Antenna conductors 1, 2 are provided on one surface of the dielectric substrate 11, and feed conductors 3, 4 are provided on the other surface. Reference numeral 24 is a via-hole connecting the antenna conductors 1, 2 and the feed conductors 3, 4. The via-hole 24 is provided close to apexes of the right angles of the antenna conductors 1, 2, and passes through the dielectric substrate 11.

The antenna of the first embodiment of the invention is obtained by any combination of FIG. 1, FIG. 3 or FIG. 4, and FIG. 2 or FIG. 5.

The antenna conductors 1, 2 are provided on one surface on the dielectric substrate 11. At central parts of the antenna conductors 1, 2, parts of the conductors that are 1/10th or less the wavelength of the usage frequency in a vacuum are removed, and the antenna conductors 1, 2 are arranged a specified distance apart. With an ideal self-complementary structure, the distance is infinitely small, but because the antenna conductors 1, 2 will fail in their function if they are short circuited, in actual manufacture there is a need for a permissible distance. If the distance is 1/10th of a wavelength or less, an electric field is almost in an ideal state and a large difference does not arise, which means that by providing a distance of 1/10th of a wavelength or less, the characteristics are not affected, and it is possible to acquire a manufacturing margin (Preferably 1/30th of a wavelength or less. If it is any smaller, the difference between an ideal state can be made sufficiently small.).

The antenna conductors 1, 2 are left right symmetrical about the axis of symmetry AS, and if they are turned 180 degrees about the point of symmetry PS the antenna conductors overlap themselves, while if they are rotated 90 degrees they overlap with the section with no pattern except for the central distant portion, giving a self complementary structure. Since the above described distance L exists, it cannot be said that the antenna of FIG. 1 has completely self-complementary structure, but the same operational effects are achieved as with an actual self-complementary antenna. From this point, it can be said that the antenna of the embodiment of the invention has a pseudo self-complementary structure. The antenna conductor 1 and the feed conductor 4, and the antenna conductor 2 and the feed conductor 3 are respectively electrically connected. Power is fed from other ends of the feed conductors 3, 4 to the antenna conductors 1, 2, but the phases of the feeds are opposite. The feed conductors 3, 4 are also symmetrical about a plane of symmetry. As shown in FIG. 2, the feed conductors 3, 4 can also be in the same plane as the antenna conductors 3, 4, and as shown in FIG. 5 the feed conductors can be in a plane at the opposite side to the antenna conductors 1, 2. In the case of FIG. 5, it is possible to form a via-hole 24 in a rear surface of the dielectric substrate 11 at a point close to point symmetrical center of the antenna conductors 1, 2, and to connect the feed conductors 3,4 to the antenna conductors 1, 2. However, in this case also, the feed electrodes are arranged symmetrically about a central plane of symmetry.

The dimensions etc. of the antenna of FIG. 1 are generally obtained as follows. The dielectric substrate has a dielectric constant of 1-12, and a thickness of 0.1-2 mm. The antenna conductors 1, 2 can be shaped as right-angled isosceles triangles as in FIG. 1, or having shapes (for example, shapes as shown in FIG. 3 and FIG. 4) covering the right-angled triangles at inside surfaces cut by two lines interposing the right angle of the isosceles triangles. The length of the two edges interposed in the right angles of the right-angled isosceles triangle is from 5-100 mm depending on the usage frequency. A distance between the antenna conductors 1, 2 is between 0.1 and 1 mm. Feed conductors 3, 4 having a width of 0.25 mm are extracted from apexes of the right-angled isosceles triangles. The feed conductors 3, 4 are symmetrical about the line of symmetry of the antenna conductors 1, 2. A distance between the feed conductors 3, 4 is from 0.05 to 1 mm. The feed conductors 3, 4 are taken out as far as outside of a square formed by ends of two edges interposed between the right angles of the conductors 1, 2.

As shown in FIG. 1, the antenna conductors 1, 2 have a self complementary structure where they overlap with sections where there is no pattern except for the central distant sections when rotated through 90 degrees, and by feeding points on the antenna conductors close to the center of point symmetry input impedance is made almost constant.

Figure 6:
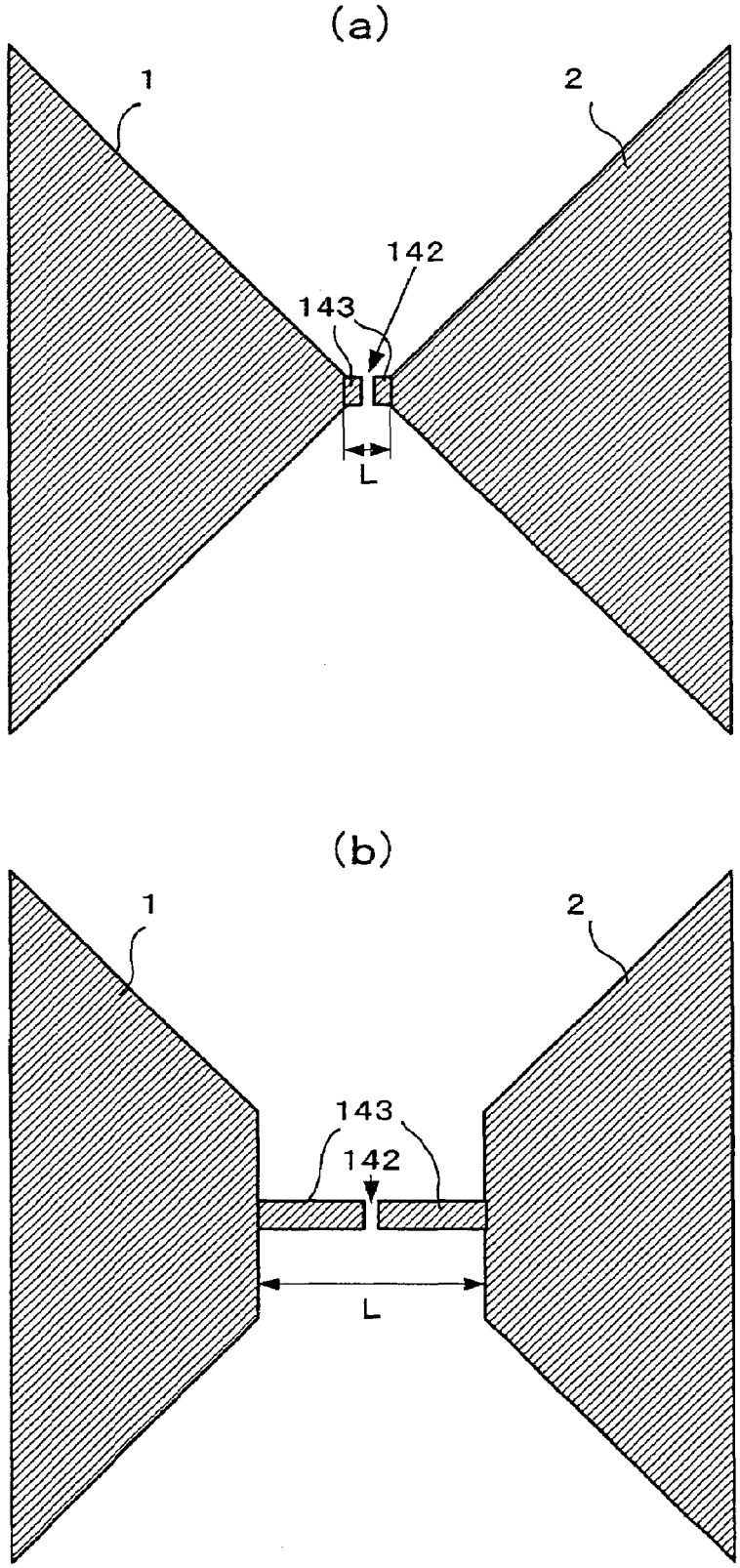
FIG. 6 shows variation in shape when widening the distance between the antenna conductors 1, 2 of the antenna module of embodiment 1 of the invention.
Figure 7:
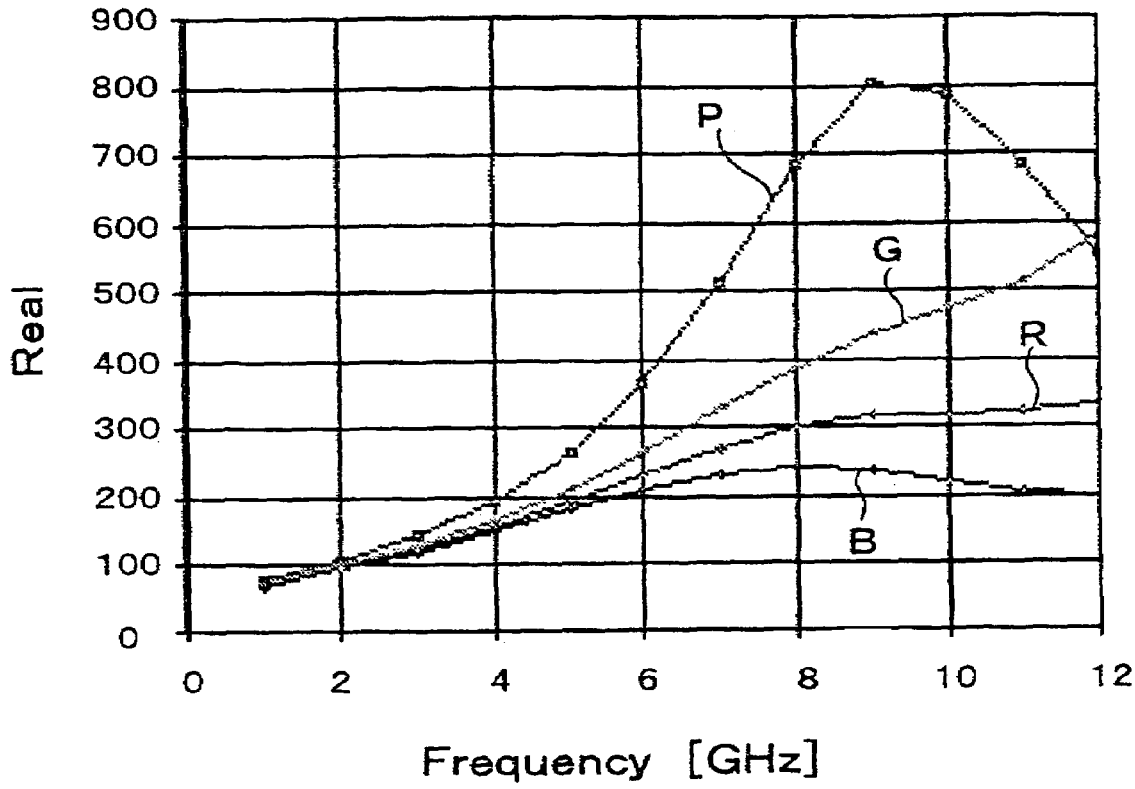
FIG. 7 is a graph showing the real component of input impedance, being a result of electromagnetic field simulation for the antenna module of embodiment 1 of the invention.

Results of evaluation using electromagnetic field simulation as to whether or not antenna impedance etc. is changed by changing the distance between the antenna conductors 1, 2 are shown in FIG. 6 and FIG. 7.

FIG. 6 shows variation on shape when widening the distance between the antenna conductors 1, 2. FIG. 6(*a*) shows the case where the distance is narrow (distance L is small), while FIG. 6(*b*) shows the case where the distance is wide (distance L is large) Reference numeral 142 is a balanced input feeding point, and 143 is a feed line.

FIG. 7 shows the real component of input impedance, being a result of electromagnetic field simulation. FIG. 7 shows the frequency dependence of distance between antenna conductors 1, 2 and antenna input impedance. With the structure of FIG. 6, if the distance L is large, a line circuit is inserted in serial from the feeding point, and this appears approximately as an inductance. Accordingly, an imaginary part of the input impedance varies with distance, and so only the real part is shown in FIG. 7. The line P in FIG. 7 is a distance of 12 mm, the line G is a distance of 9 mm, the line R is a distance of 6 mm, and the line B is a distance of 2 mm. With the line B in FIG. 7 for an extremely narrow distance, impedance is almost constant from about 5 GHz, but as the distance widens the self-complementary characteristics deteriorate and so the degree of constancy of the impedance deteriorates. It can be seen from the line R in FIG. 7 for a distance of 6 mm that there is a limit to the level of fixed impedance, and so a distance of 6 mm is considered to be the target limit. Due to theorem of similarity of the electromagnetic fields, in the event that the frequency becomes multiplied by "a" (wavelength is divided by "a") if the dimension is made 1/a, the electromagnetic fields become similar to each other at a corresponding frequency, and therefore, if values where the distance is divided at the wavelength are equal, each antenna has equal characteristics at the corresponding frequency (reference:Y. Mushiake, "Self-complementary Antennas" Springer-Verlag London Limited 1996.

The wavelength of 5 GHz in air is 6 cm, and a distance of 6 mm is 1/10th of a wavelength, which means that when a pattern at the central part of the antenna is cut within a length under 1/10th of a wavelength or less, it is considered that a fixed impedance characteristic is ensured. In order to further ensure a fixed impedance, it is preferable to have a distance of 2 mm, that is 1/30th of a wavelength, or less.

As an example, an antenna having the structure described below was test produced and the characteristics measured.

As a dielectric substrate, a substrate having a dielectric constant of 3.6 and a dielectric thickness of 200 μm was used. The length of two edges interposed in right angles of antenna conductors 1, 2 shaped as right-angled isosceles triangles is 28 mm. A distance between the antenna conductors 1, 2 is 0.25 mm, and feed lines having a width of 0.25 mm are extracted from apexes of the right angles of the antenna conductors 1, 2 symmetrically about the line of symmetry of the antenna conductors 1, 2. A distance between the feed conductors 3, 4 is 0.25 mm. The feed conductors 3, 4 are taken out as far as outside of a square formed by ends of two edges interposed between the right angles of the antenna conductors 1, 2.

Figure 8:
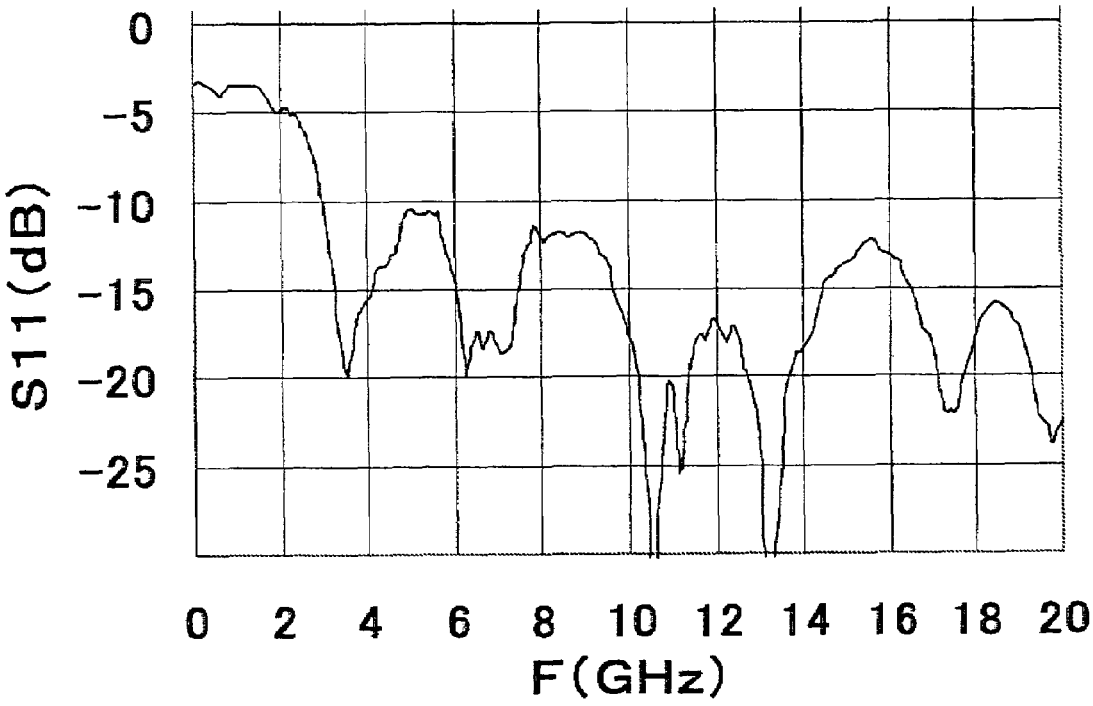
FIG. 8 is a graph showing measurements of amount of reflected power when a balanced signal is input with an output section load of 188 ohms in the antenna of embodiment 1 of the invention.

FIG. 8 shows measurements of amount of reflected power when a balanced signal is input in the antenna with an external load of 188 ohms. FIG. 8 shows a reflection coefficient (S11) for the antenna example in order to describe the effects of the antenna relating to embodiment 1 of the invention. The horizontal axis shows frequency while the vertical axis shows S11 expressed in dB, and the expression S11<−10 (dB) is satisfied from about 3 GHz to 20 GHz.

This reflected power amount represents power from an external circuit that is reflected by the antenna and not conveyed to the antenna, and it is common practice to use this value in a region of −10 dB or less, as a criterion of bandwidth. According to FIG. 8, reflection S11 from 3 GHz to 20 GHz is −10 dB or less, and it is demonstrated that the antenna has excellent broadband characteristics.

As should be clear from the above description, according to embodiment 1 of the present invention, it is possible to realize an antenna with little reflection loss over an extremely wideband range.

Embodiment 2

Figure 9:
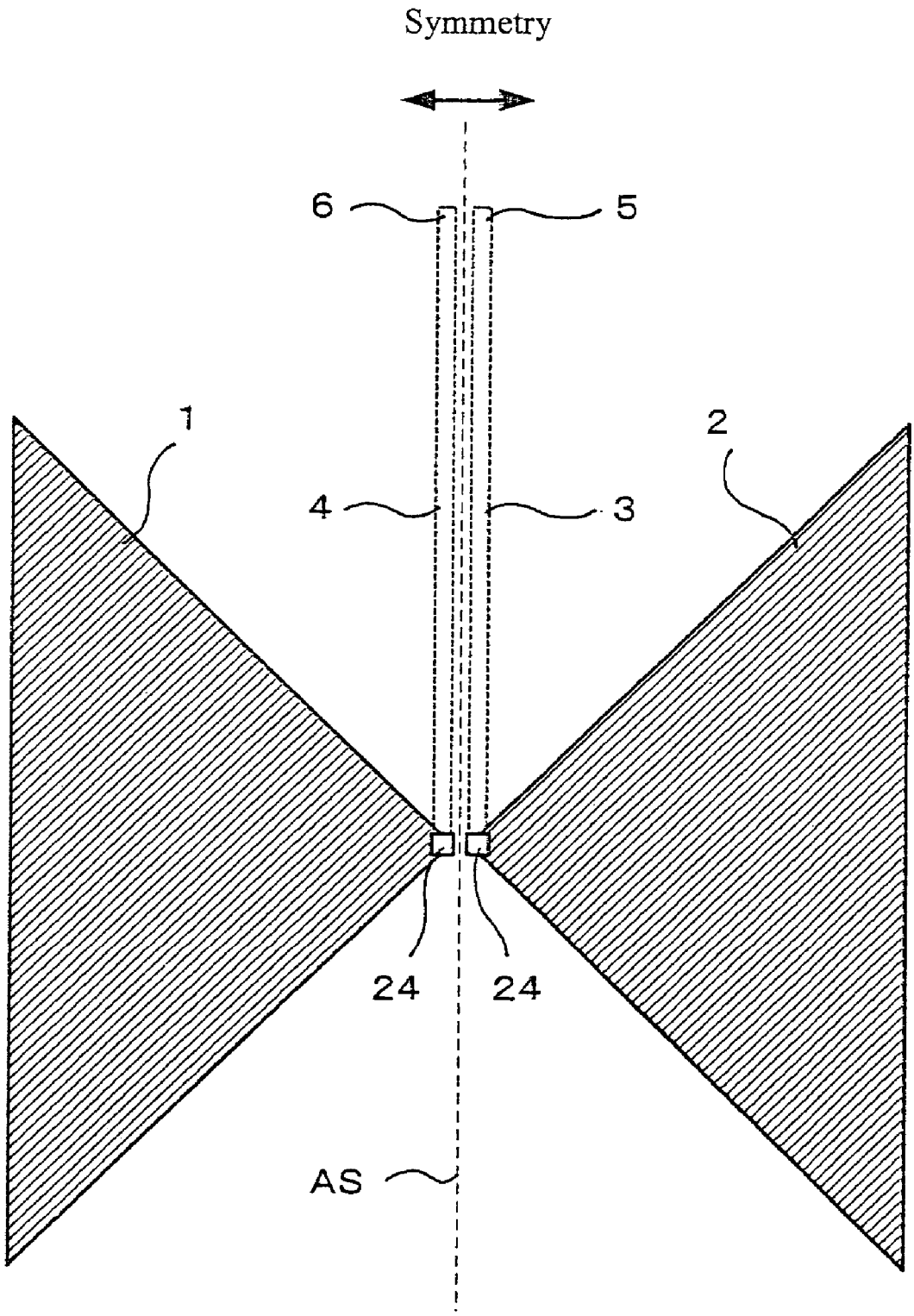
FIG. 9 is a plan view of an antenna module relating to embodiment 2 of the invention.
Figure 10:
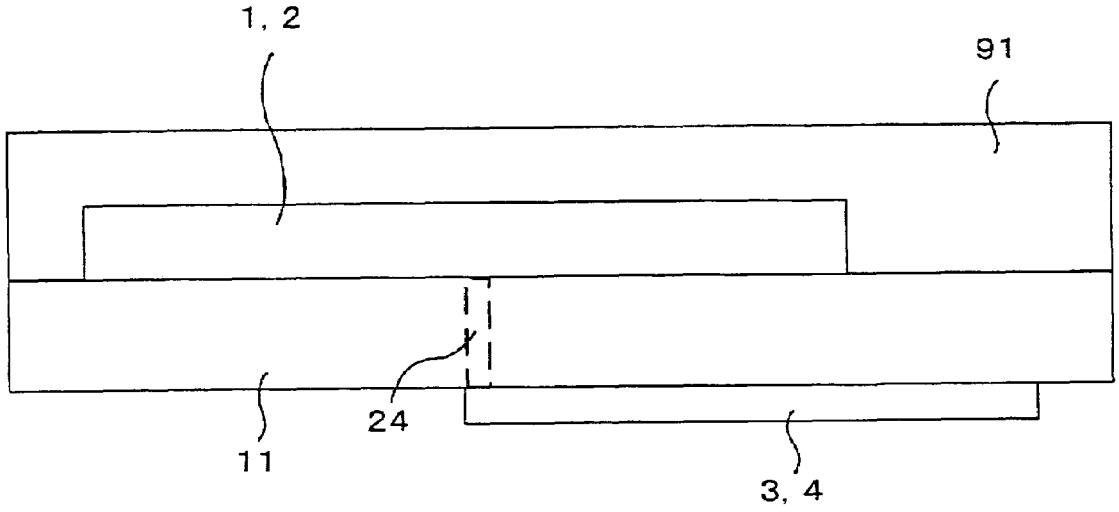
FIG. 10 is a right side view of the antenna module relating to embodiment 2 of the invention.

With embodiment 1 of the present invention, a dielectric substrate is provided on one surface of the antenna conductor, but it is also possible to provide a dielectric substrate on both surfaces. Examples of embodiment 2 of the present invention are shown in FIG. 9 and FIG. 10. In these drawings, the same reference numerals are attached to sections that are the same as or correspond to those in the above-described embodiment.

FIG. 9 is a plan view of an antenna module relating to embodiment 2 of the invention. The feed conductors 3, 4 are provided on a rear surface on the dielectric substrate. As a result, via-holes 24, 24 are provided in order to connect the antenna conductors 1, 2 and the feed conductors 3, 4. Signals that are 180 degrees out of phase with each other are fed from sections 5, 6.

FIG. 10 is a right side view of an antenna module relating to embodiment 2 of the invention. Reference numeral 91 is a second dielectric substrate provided on the antenna conductors 1, 2 and the dielectric substrate 11.

The structure of embodiment of the invention is the same as the first embodiment with respect to the antenna conductors 1, 2, but a second dielectric substrate 91 is also provided with the dielectric substrates being arranged on both surfaces of the antenna conductors 1, 2. In order to connect to external circuits, the feed conductors 3, 4 are provided on a rear surface of the dielectric substrate 11, and are connected to the antenna conductors 1, 2 by means of via-holes 12 (it is also possible to provide the feed conductors 3, 4 on the main (or front) surface of the second dielectric substrate 91).

With the structure of embodiment 2 of the invention, since the dielectric bodies 11, 91 are on both surfaces of the antenna conductors 1, 2, the effective relative dielectric constant is even higher than with the structure of embodiment 1 of the invention, and as well as the value at the time of constant impedance becoming lower, it is made possible to obtain the same electrical characteristics even with a shorter physical length as the electrical length is shorter, enabling miniaturization of the antenna. Since the antenna impedance of this invention is comparatively high, a lower impedance is more effective to enable matching over a wide band with low loss when connecting to a balanced circuit of 50 ohms (the impedance between lines is 100 ohms because it is double due to being interposed by ground) that is often used with high frequencies.

Figure 11:
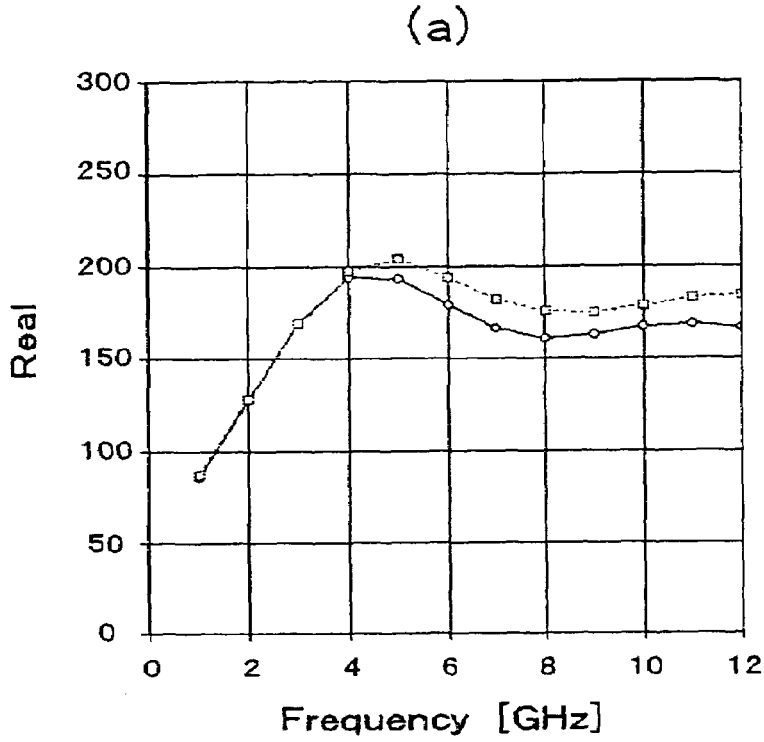
FIG. 11 is a graph showing results of comparing the result of electromagnetic field simulation of embodiment 1 and embodiment 2 of the invention for input impedance of the antenna module.
Figure 11:
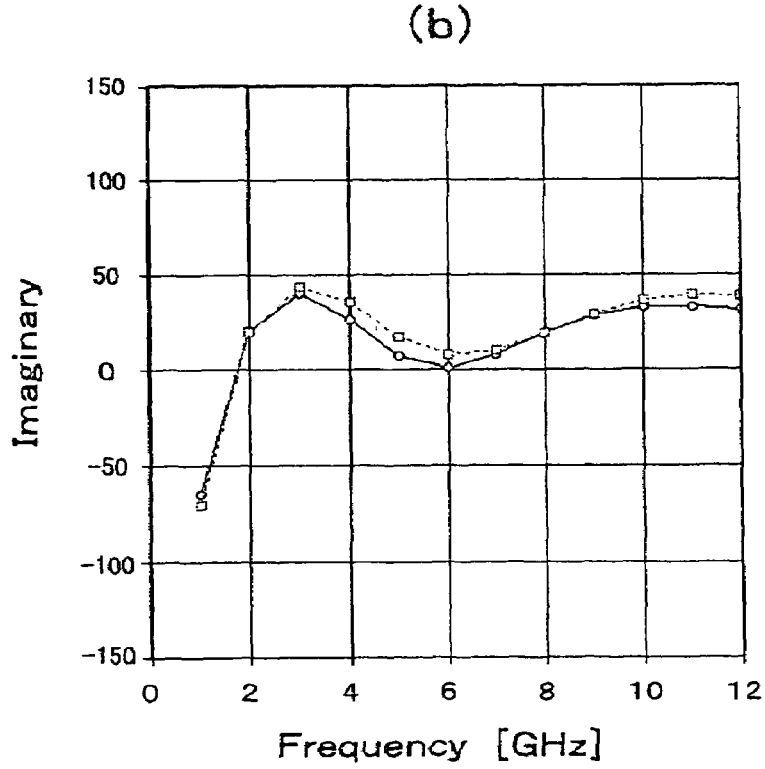

Similarly, with respect to the shape and dimensions of the antenna conductors, FIG. 11(*a*) and FIG. 11(*b*) show comparative effects of electromagnetic field simulation for input impedance of the first embodiment of the invention with a dielectric body arranged on only one side, and the input impedance of the second embodiment of the invention with dielectric bodies arranged on both sides. In these drawings, the solid line represents the case of the second embodiment of the invention while the dotted line represents the first embodiment of the invention. The structure of each part of an antenna module of the simulation of FIG. 11 is as follows. The dielectric substrate 11 has a dielectric constant of 3.6 and a thickness of 200 μm. The length of two edges enclosed in a right angle of a right-angled isosceles triangle of the antenna conductors 1, 2 is 28 mm. With the simulation, feed lines are not provided between the antenna conductors 1, 2 and feed is carried out directly. With the simulation, it is possible to have an infinitely small feed point, and the value of this input impedance is obtained from only the antenna conductors 1, 2.

According to FIG. 11(*b*), with either of the first or second embodiment of the invention, an imaginary part is close to 0 and there is no significant difference between the two. However, as shown in FIG. 11(*a*), compared to input impedance of the first embodiment of the invention shown by the dotted line, the input impedance of the second embodiment shown in the solid line is reduced.

Embodiment 3

Figure 12:
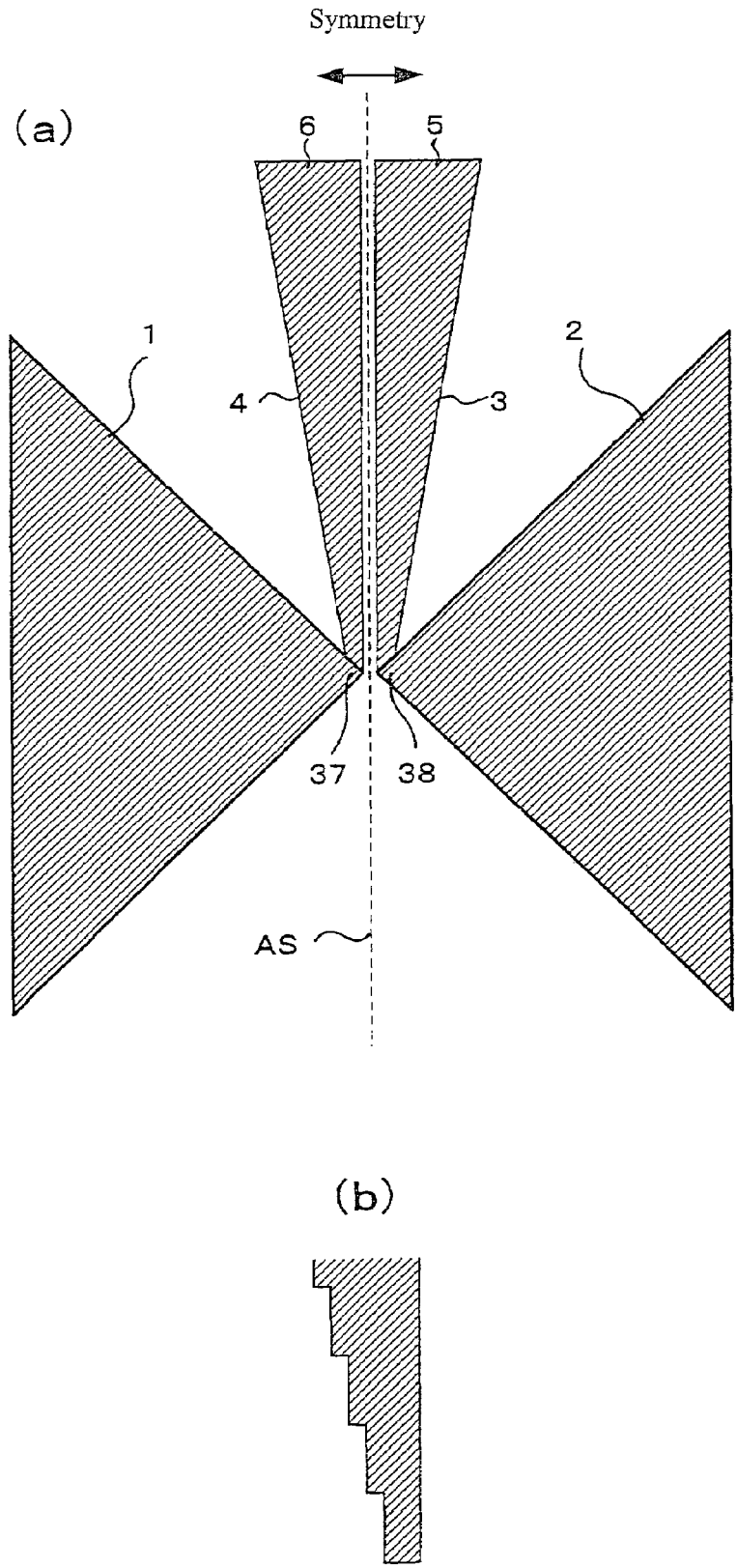
FIGS. 12(*a*) and 12(*b*) are a plan view of an antenna module relating to embodiment 3 of the invention.

It is possible to endow the feed conductors with a impedance conversion function. Examples of embodiment 3 of the present invention are shown in FIG. 12. FIG. 12 is a plan view of an antenna module relating to embodiment 3 of the invention. In this drawing, the same reference numerals are attached to sections that are the same as or correspond to those in the above-described embodiment.

In FIG. 12, reference numerals 37 and 38 are antenna conductor 1, 2 side ends of the feed conductors 3, 4, and the feed conductors 3, 4, are electrically connected to the antenna conductors 1, 2 at these sections. The antenna conductors 1, 2 and the feed conductors 3, 4 are symmetrical about a plane of symmetry, signals that are 180 degrees out of phase are fed from ends 5, 6 of the feed conductors opposite to the antenna, and this point is the same as for the case of embodiment 1 of the invention.

In embodiment 3 of the invention, if the width of the end 5 of the feed conductor 3 is compared with the width of the other end 38 (the end at the antenna conductor 2 side) the width becomes monotonically larger moving from the end 38 to the end 5. The same applies to the width of the end 6 of the feed conductor 4 and the width of the other end 37 (antenna conductor 1 end). With the example of FIG. 12(*a*), width varies smoothly, but it is also possible for this width to vary in a non-continuous manner so as to become the same size. It is also possible to have a stepped shape, as shown, for example, in FIG. 12(*b*). In addition to the width varying smoothly at a constant inclination, the inclination may vary depending on the place, or vary in a partially non-continuous manner. The phrase "monotonically" also includes these cases. In short, the width should become gradually thinner or wider going from one end to the other, and should not become adversely wider in the middle becoming narrower. What this means is that "monotone" corresponds to monotonically increasing or decreasing as used in mathematics.

In FIG. 12, the width of the feed conductors 3, 4 at the sides 37, 38 connecting to the antenna conductors 1, 2 is narrower than the opposite sides 5, 6, but conversely it is also possible for the width at the opposite sides 5, 6 to be narrower than the sides 37, 38, or for the width to vary monotonically midway along.

In embodiment 3 of the invention, the structure of the antenna conductors 1, 2 and the dielectric substrate 11 is the same as for embodiment 1 and embodiment 2 of the invention. The width of the feed conductors 3, 4 is narrow at parts 37, 38 connected to the antenna conductors 1, 2, and wide at sides (at the ends 5, 6) fed from outside. The width of the feed conductors 3, 4 may also be constant, or vary in a monotonic manner, and the two feed conductors 3, 4 are symmetrical with respect to the plane of symmetry of the antenna conductors 1, 2. Since the width of the feed conductors 3, 4 is as described above, even when output impedance of an LSI connected to the feed conductors 3, 4 is lower than the antenna input impedance, external signal source impedance is matched to the antenna.

When the LSI output impedance is higher than antenna input impedance, opposite to the situation described above, the width of the feed conductors 3, 4 is such that it is wide at parts 37, 38 connected to the antenna, and becomes narrow at sides 5, 6 fed from outside. The circuit line widths may also be constant, or vary in a monotonic manner, and the two feed conductors 3, 4 are symmetrical with respect to the plane of symmetry of the antenna conductors 1, 2.

As shown in FIG. 12, the width of the feed conductors 3, 4 is made narrow at sections 37, 38 connected to the antenna conductors 1, 2 and is wide at sections 5, 6 fed from outside, which makes it possible to convert impedance between an antenna feed point and a feed point from outside, and it is possible to reduce reflections at the antenna and the feed point. Width of the feed lines is selected from 0.05 mm or above to 4 mm or less so as to satisfy impedance matching between the antenna and a feed point from outside. A feed line pattern impairs the self complementary characteristics, but because the feed line pattern comparatively small and a current source is symmetrical about the plane of symmetry of the antenna conductor pattern, so that the self complementary characteristics are not lost, there is no significant loss over a wide band.

In order to demonstrate the effects of the structure of embodiment 3 of the invention, an impedance converting effect as described in the following is shown using electromagnetic field simulation. Here, impedance of circuit lines when obtaining impedance matching is a value between the impedance of the two sides, which means that if impedance can not be realized at a value between the impedance of the two sides it is not possible to achieve matching.

Figure 13:
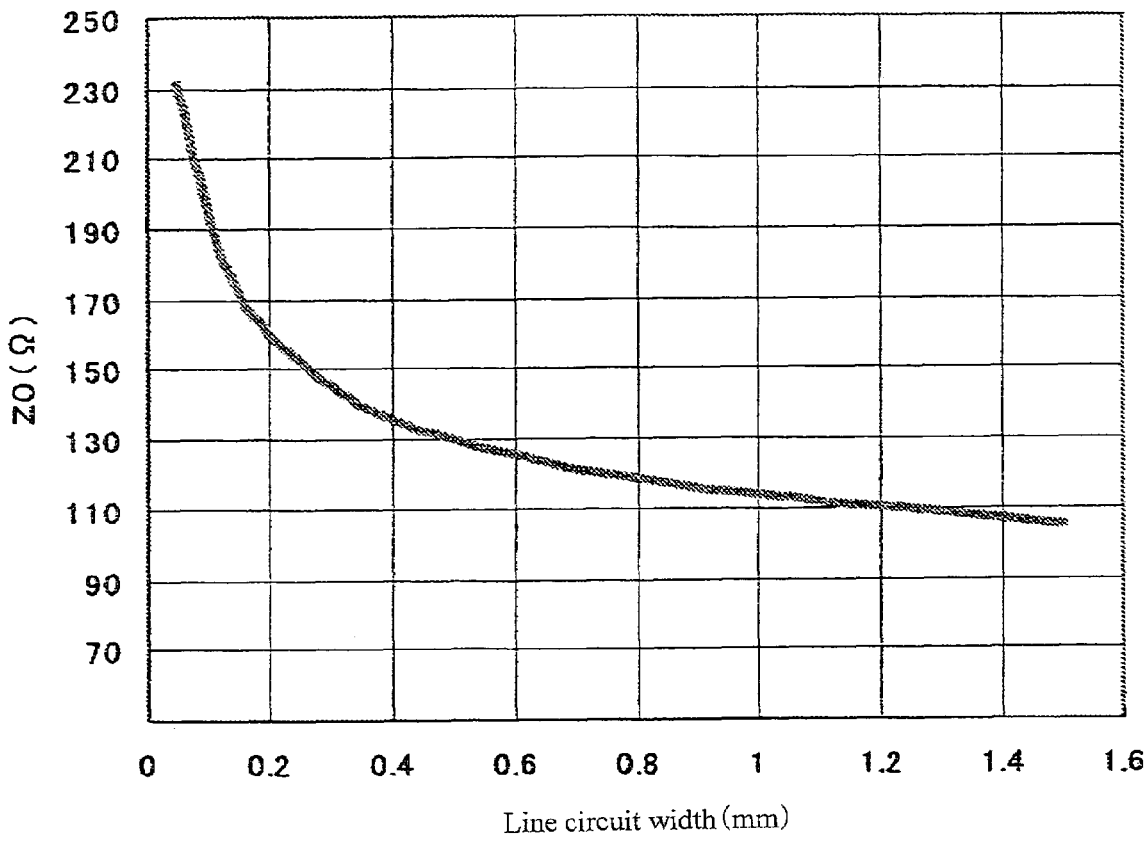
FIG. 13 is a graph showing a relationship between line width of lecher lines formed in a same plane, and characteristic impedance of the lines, in order to describe operation of embodiment 3 of the invention.

FIG. 13 shows a relationship between line width of lecher wires formed on a same plane and characteristic impedance of the lines, in order to describe operation of embodiment 3 of the invention. FIG. 13 shows a relationship between characteristic impedance for lines of a constant width and line width. The dielectric constant of the dielectric body is 3.6, dielectric thickness is 0.2 mm, and a distance between lines is 0.15 mm. According to FIG. 13, characteristic impedance does not really become any smaller after the line width exceeds, which means that in the event that the line width is sufficiently narrow as to not impair the self complementary characteristics, conversion to a low impedance is difficult. However, in the event that impedance of the two sides is from 130 to about 200 ohms, it is made possible to easily achieve impedance matching.

Figure 14:
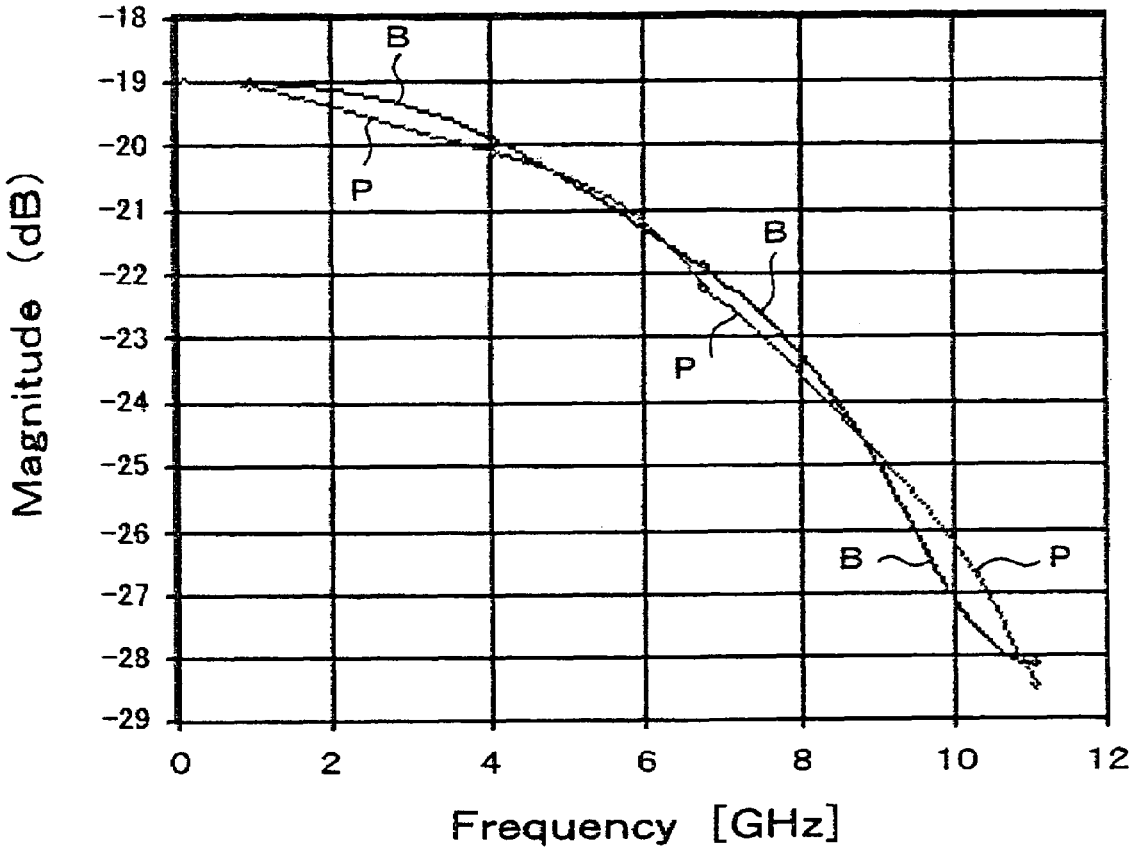
FIG. 14 is a graph showing a reflection coefficient for feed lines in order to describe operation of embodiment 3 of the invention.

FIG. 14 shows electromagnetic field simulation results for a reflection coefficient of a balanced signal on the feed lines, with an example having an antenna side impedance of 188 ohms and an external feed side impedance of 150 ohms. FIG. 14 shows a reflection coefficient for feed lines in order to describe operation of embodiment 3 of the invention. Then antenna conductor 37, 38 side impedance is 188 ohms and external feed side 5, 6 impedance is 150 ohms. The line B in FIG. 14 shows S11 expressed as dB, and the line P shows S22 expressed as dB. In a range of 3.1-10.6 GHz, S11 and S22 are both less than −19 dB, and reflection is sufficiently small.

The shape of the lines at this time is such that an antenna conductor side width is 0.1 mm, an external feed point side is 0.25 mm, and a gap is 0.15 mm. As well as antenna side reflection S11 and feed side refection S22, reflection spanning the wide band of the UWB band currently permitted in the US (3.1-10.6 GHz) has almost no reflection loss at less than −19 dB, and it will be understood that favorable matching is achieved.

As should be clear from the above description, according to the antenna relating to embodiment 3 of the present invention, it is possible to realize an antenna with little reflection loss over an extremely wideband range and which can achieve matching of impedance between an external feed section and the antenna.

Embodiment 4

Figure 15:
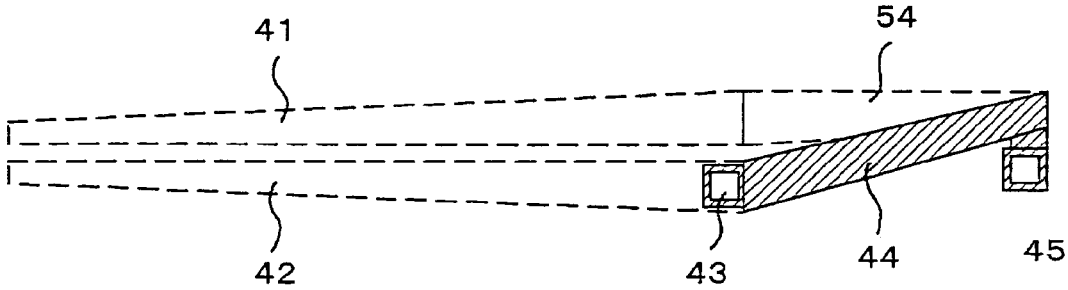
FIG. 15 is a plan view of an antenna module relating to embodiment 4 of the invention.
Figure 15:
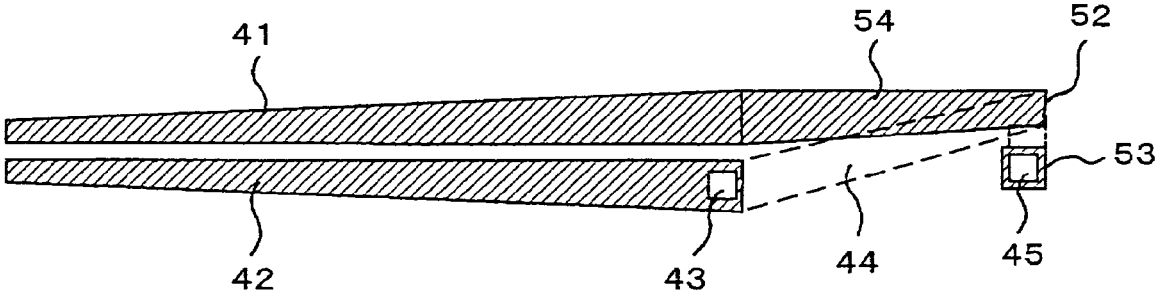

Embodiment 4 of the present invention is shown in FIG. 15(*a*) and FIG. 15(*b*). Since the antenna section is the same as embodiment 1 of the invention, only the feed section is shown.

FIG. 15 shows plan views of embodiment 4 of the invention, with FIG. 15(*a*) showing a surface where the antenna and a feed line are connected, and FIG. 15(*b*) showing an opposite surface. In order to simplify understanding, FIG. 15(*a*) and FIG. 15 (*b*) are drawn as plan views looking from the same direction (normally, plan views of two surfaces have a mirror image relationship, but that is not the case with drawings). Reference numeral 41 is a feed conductor connected to an antenna conductor, being at the opposite surface of FIG. 15(*a*), and 42 is another feed conductor. 43 is a via-holes connected the feed conductor 42 and a feed conductor 44 on the surface of FIG. 15 (*a*), and 45 is a via-holes connecting the conductor lines 42, 44 from the surface of FIG. 15(*a*) to the surface of FIG. 15(*b*). 52 and 53 are feed points for feeding to the antenna.

As shown in FIG. 15, the feed conductor 42 connected to the antenna is connected by means of a via-hole and the feed conductor 44 formed on the opposite surface of the dielectric substrate. The feed conductor 44 crosses the other feed conductor 54 sandwiching the dielectric substrate, and after that the feed conductor 44 moves toward the via-hole 45 and is taken out to the same surface as the feed conductor 54 using the via-hole 45. Connection is made to an external circuit at the point of 53. The other feed conductors 41, 54 are only constructed on the same surface of the dielectric substrate, and are connected to an external circuit at the point of 52. The feed conductor 44 and the feed conductor 54 may have the line thickness either widening or narrowing from the left side of the drawing to the right side of the drawing, depending on the thickness of the dielectric substrate and the dimensions of the feed conductors 41 and 42.

In embodiment 4 of the invention, the antenna section is the same as the antenna conductors of embodiments 1 and 2 of the invention, and the structure of the dielectric substrate is the same, but the feed conductors are as shown in FIG. 15. The feed conductor 44 and one other feed conductor 54 constitute a lecher wire sandwiching the dielectric substrate. The structure of the lecher wire constructed sandwiching the dielectric structure is such that generally characteristic impedance can be made smaller than a lecher wire arranged on the same surface, which means that it is possible to convert to a lower impedance. For this reason, impedance conversion is carried out using a lecher wire formed sandwiching the dielectric substrate, and it is possible to convert an impedance between the feed points 52 and 53 to a quite low impedance of 100 ohms +/31 20 ohms. Making the impedance between the feed points 52 and 53 100 ohms means that when the circuits of the feed points 52, 53 respectively become 50 ohms circuits with respect to ground, a state where there is no reflection is exhibited. Therefore, since matching is achieved to an impedance of 50 ohms which is standard for use with high frequency components, matching to high frequency components available on the market is achieved without the use of an impedance matching circuit, which is efficient.

According to embodiment 4 of the invention, since some of the feed lines constitute lecher wires sandwiching the dielectric body, it is possible to achieve a lower impedance than with embodiment 3 of the invention. As a result, even if the antenna side impedance is the same, it becomes possible to achieve matching with a lower external impedance.

According to embodiment 4 of the present invention, it is possible to realize an antenna with little reflection loss over an extremely wideband range and which can also achieve impedance matching to a comparatively low impedance external feed section.

Embodiment 5

Figure 16:
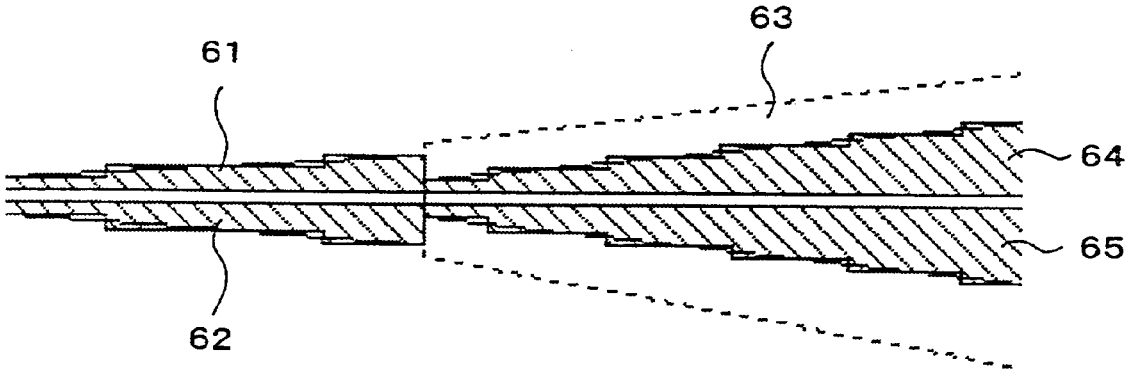
FIG. 16 is a plan view of an antenna module relating to embodiment 5 of the invention.

FIG. 16 is a plan view of embodiment 5 of the present invention. Since the antenna section is the same as embodiment 1 of the invention, only the feed section is shown.

In FIG. 16, since the antenna section is the same as embodiment 1 of the invention, only the feed section is shown. Reference numerals 61 and 62 are feed conductors for connecting to the antenna conductors, and reference numeral 63 is a conductor arranged on an opposite surface to the dielectric substrate (a surface that is different to the surface on which the feed conductors 61 and 62 are arranged). The conductor 63 is connected to ground. Reference numerals 64 and 65 are microstrip lines for connecting to the feed conductors 61, 62. The feed conductors 61 and 62 widen gradually in width moving from a point of connection to the antenna conductors, and the width is varied such that at a boundary between the feed conductor 61 and the microstrip line 63 the characteristic impedances of the two become the same. The widths of the feed conductor 62 and the microstrip line 64 are also the same.

With embodiment 5 of the invention, the feed conductors 61 and 62 are connected to microstrip lines 64 and 65 having ground surfaces on opposite surfaces. The widths of the microstrip connection lines are selected to be of such a width that an impedance R1 of lecher wires constituted by the feed conductors matches at a point where they connect and an impedance R2 of the microstrip connection lines 64, 65 in odd mode.

With the structure of embodiment 5 of the invention, there is connection from the lecher wires 61 and 62 to the microstrip connection lines 64 and 65. With a high frequency circuit, in order to make the ground voltage constant it is common to provide an electrode that is grounded. In the vicinity of an antenna section having this structure, it is better if the ground electrode is far away, but there are many cases where it is better to have the ground electrode at a section connected from the feed conductors to the external circuit.

Embodiment 5 of the invention makes it possible to convert to a balanced circuit containing a ground electrode at a midpoint of a feed line. The microstrip connection lines have voltage and current out of phase by 180 degrees between lines at the time of odd mode, and the same phase as those of the lecher wires, which means if the line width is selected so that at connection sections between the lecher wires and the microstrip connection lines a difference between the impedance of the lecher wires and the odd mode impedance is small, it is possible to connect at a line join with almost no reflection loss. Here, the odd mode impedance is defined as the impedance with respect to ground, and so the odd mode impedance between lines of the microstrip connection lines is the result of adding the impedance from one line to ground to the impedance from ground to the other line. With a symmetrical circuit, the two impedances are equal, which means that the impedance between the lines becomes twice the odd mode impedance. Therefore, by selecting the line width and distance between lines so that the impedance of the lecher wires becomes twice the impedance of the microstrip odd mode impedance, it is possible to make impedances at line joins equal, and to have almost no reflection loss, and to have impedance conversion with no loss.

As will be clear from the above description, according to embodiment 5 of the invention, since it is possible to realize a simple antenna module that has low reflection loss and does not require a balun (balanced to unbalanced converter), a high performance, high yield, low cost module is possible.

Embodiment 6

The above-described embodiments relate to an antenna module. Embodiment 6 of the invention relates to a wireless module using the above described antenna module.

Figure 17:
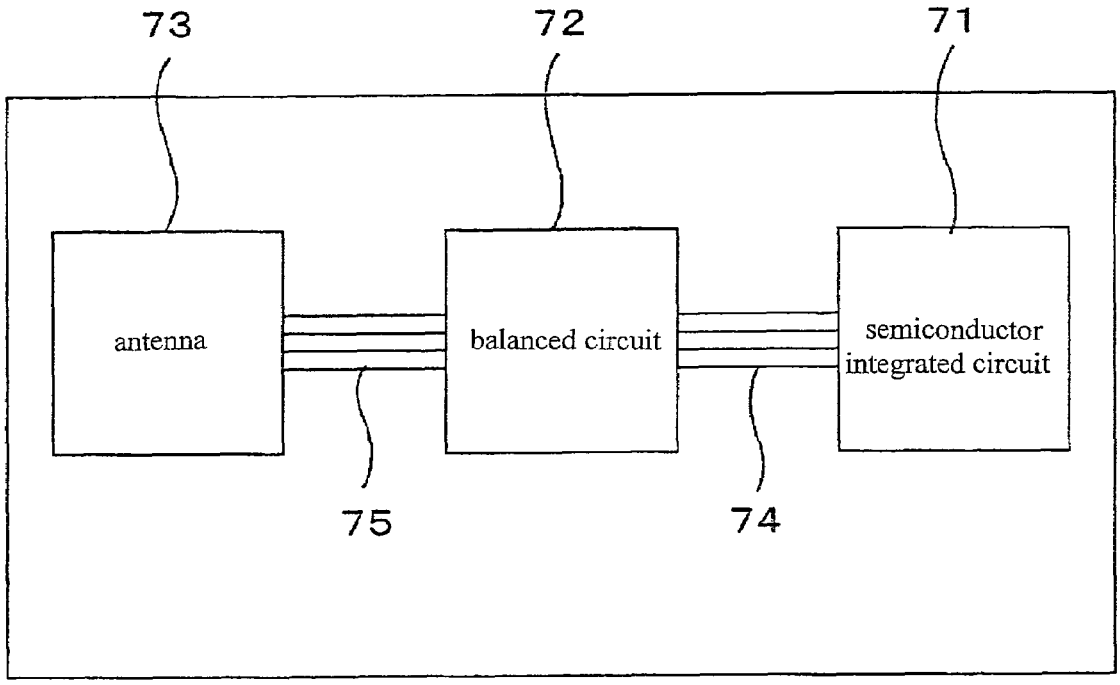
FIG. 17 is a block diagram of a wireless module relating to embodiment 6 of the invention.

FIG. 17 is a block diagram of a wireless module relating to embodiment 6 of the invention. This wireless module is constituted by only a balanced circuit. Reference numeral 71 is a semiconductor integrated circuit for generating a wideband signal, 72 is a circuit such as a filter constituted by the balanced circuit, and 73 is a wideband antenna for embodiments 1-5 of the present invention. 74 and 75 are balanced circuits constituted my impedance matched lecher lines or odd mode connection line circuits.

The semiconductor integrated circuit 71 has an output impedance in the range 80 to 300 ohms, and outputs a differential signal. At this time, output impedance is designed to the output impedance by adjusting gate width in the case of field effect transistors, or by adjusting emitter area in the case of bipolar transistors. The impedance of the antenna relating to this embodiment of the present invention changes from about 80-300 ohms depending on structural dimensions, but by selecting the output impedance of an-LSI that is close by, it is possible to more simply achieve impedance matching using the methods shown in embodiments 3-5 of the invention. It is also possible to have a balanced circuit such as a mixer between 73 and the LSI 71, instead of the balanced line circuit.

The wireless module circuit is constituted so that a differential signal is taken out from the LSI 71 having an output impedance of 80-300 ohms using two impedance matched lecher wires or a odd mode connection line circuit 74, and this signal is connected to the balanced circuit 72 so that the balanced output of a balanced circuit 72 such as a balanced mixer constituted by a balanced circuit is input to the antenna of embodiments 1-5 of the present invention using lecher wires or odd mode connection line circuits 75 that achieve impedance matching of the balanced outputs of a balanced circuit 72. The intermediate balanced circuit 72 is not absolutely necessary, and in the event that it is not provided, there is a direct connection from the LSI 71 to the antenna 73 using impedance matched lecher wires or odd mode connection line circuits 74.

At the balanced circuit 72 and the antenna 73, it is necessary to input signals that are 180 degrees different in phase from one another, but with a circuit constituted only by the balanced circuit as shown in FIG. 1, since phase changes by the same extent along two lines differential signals output from the LSI 71 maintains a phase difference of 180 degrees at any position on the line circuit. Also, since impedance conversion is carried out by the line circuits 74 and 75, reflection at the input and output ends of the LSI 71, balanced circuit 72 and antenna 73 is also small, and it is possible to construct a module having little loss. The balanced circuit 72 is not necessary, but in this case the LSI 71 and the antenna 73 are directly connected by two impedance matched lecher wires or odd mode connection line circuits. By setting the impedance of the LSI 71 in this case to a value of 80-300 ohms roughly equal to the impedance of the antenna 73, impedance conversion is not really required and a wideband and low loss connection is possible. With a high frequency module normally having a balanced circuit and an unbalanced circuit, a balanced/unbalanced conversion circuit (balun) is required, but with the wireless module having this structure, it is possible to omit the balun as there is only the balanced circuit, enabling simplification of the module structure, reduced cost and increased yield.

The present invention is not limited to the above-described embodiment, and various modifications are possible within the scope of the attached claims. These are also included within the spirit and scope of the present invention.

What is claimed is:

1. An ultra-wideband antenna, provided with a dielectric substrate, a plurality of antenna conductors formed on one surface of the dielectric substrate that are pseudo self-complementary on the surface, and a plurality of feed conductors symmetrical with respect to a symmetrical surface of the antenna conductors, wherein a gap for a wavelength of 1/10 or less that of the wavelength of a usage frequency in a vacuum is provided at a center of rotational symmetry between the plurality of antenna conductors, and wherein a second dielectric substrate is further provided on the antenna conductors, arranged so that the antenna conductors are sandwiched by a plurality of dielectric substrates.

2. The ultra-wideband antenna of claim 1, wherein the plurality of feed conductors are provided on a surface opposite to the surface provided with the plurality of antenna conductors, and there are provided a plurality of via holes passing through the dielectric substrate symmetrically with respect to symmetrical surfaces of the plurality of antenna conductors to connect the plurality of feed conductors to the plurality of antenna conductors.

3. The ultra-wideband antenna of claim 1, wherein widths of the feed conductors at a conductor body side are different from width thereof at an opposite end, and width of the feed conductors changes monotonically between the two ends.

4. The ultra-wideband antenna of claim 1, wherein one of the feed conductors includes a first section provided on the same surface as the other feed conductor, and a second section provided on the surface opposite to the surface, and via holes are provided passing through the dielectric substrate to connect the first section to the second section, wherein the second section and the other feed conductor constitute lecher wires sandwiching the dielectric substrate.

5. The ultra-wideband antenna of claim 1, provided with a microstrip connection line including ground conductors provided on a surface opposite to a surface provided on the feed conductors, wherein the feed conductors are connected to the microstrip connection line.

6. An ultrahigh frequency circuit module, made up of only balanced circuits, provided with an ultra-wideband antenna, a semiconductor integrated circuit, and a connection line:

wherein the ultra-wideband antenna is provided with a dielectric substrate, a plurality of antenna conductors formed on one surface of the dielectric substrate that are pseudo self-complementary on the surface, and a plurality of feed conductors symmetrical with respect to symmetrical surfaces of the antenna conductors, wherein a gap for a wavelength of 1/10 or less that of the wavelength of a usage frequency in a vacuum is provided at a center of rotational symmetry between the plurality of antenna conductors;

wherein the semiconductor integrated circuit has an output impedance of greater than or equal to 80 ohms and less than or equal to 300 ohms, for outputting a differential signal; and wherein the connection line is for connecting the antenna and the semiconductor integrated circuit.

7. The ultrahigh frequency circuit module according to claim 6, wherein the connection line between the ultra-wideband antenna and the semiconductor integrated circuit is a coupling line for differential signals.

* * * * *

UNITED STATES PATENT AND TRADEMARK OFFICE

CERTIFICATE OF CORRECTION

PATENT NO. : 7,265,717 B2
APPLICATION NO. : 10/971490
DATED : September 4, 2007
INVENTOR(S) : A. Saitou et al.

It is certified that error appears in the above-identified patent and that said Letters Patent is hereby corrected as shown below:

On the Title Page,

| | | |
|---|---|---|
| Item: [73]<br>Pg. 1, col. 2 | Assignee | "YKC Corporation, Tokyo (JP)" should read --YKC Corporation, Tokyo (JP); Campus Create Co. Ltd., Tokyo (JP)-- |

Signed and Sealed this

Twenty-fifth Day of November, 2008

JON W. DUDAS
*Director of the United States Patent and Trademark Office*